US006490733B1

(12) United States Patent
Casaubon

(10) Patent No.: US 6,490,733 B1
(45) Date of Patent: Dec. 10, 2002

(54) SYSTEM FOR INTEGRATING A HARNESS INTO A FIRE FIGHTING PROTECTIVE GARMENT

(76) Inventor: Josée Casaubon, 30, Montée de la Carrière, St-Colomban, Québec (CA), J0R 1N0

( * ) Notice: Subject to any disclaimer, the term of this patent is extended or adjusted under 35 U.S.C. 154(b) by 0 days.

(21) Appl. No.: 09/956,265

(22) Filed: Sep. 20, 2001

(51) Int. Cl.[7] ..... A41D 13/00
(52) U.S. Cl. ..... 2/81; 2/79
(58) Field of Search ..... 2/81, 69, 227, 2/79, 97, 300, 311–312, 228, 230; 182/3–4, 6

(56) References Cited

U.S. PATENT DOCUMENTS

| | | | | | |
|---|---|---|---|---|---|
| 5,136,724 | A | * | 8/1992 | Grilliot et al. | 182/3 |
| 5,157,790 | A | * | 10/1992 | Aldridge | 2/227 |
| 5,168,582 | A | * | 12/1992 | Aldridge | 2/227 |
| 5,289,590 | A | * | 3/1994 | Larson | 2/227 |
| 6,105,169 | A | * | 8/2000 | Colorado | 182/6 |

* cited by examiner

*Primary Examiner*—Gloria M. Hale
*Assistant Examiner*—Tejash Patel

(57) ABSTRACT

The system includes an interior garment, such as a short mesh pant, which fits inside the firefighter pant and over his station wear. The safety harness is removably fixed to the short pant through the harness belt and the short pant harness combination is removably attached to the firefighter pant.

10 Claims, 3 Drawing Sheets

SYSTEM FOR INTEGRATING A HARNESS INTO A FIRE FIGHTING PROTECTIVE GARMENT

BACKGROUND OF THE INVENTION (a) Field of the Invention

The present invention relates to a system for integrating a safety harness into a fire fighting protective garment. More specifically, this invention relates to a mesh, preferably fire-resistant, that will hold in place a safety harness between the inner lining fabric of the firefighter protective trouser and the station wear pant of the firefighter thereby eliminating the need for openings in the liner or outer shell of the garment. More particularly, the invention will permit the integration of a wide range of commercially available safety harnesses into the firefighter garment. As well, the invention is concerned with permitting the easy inspection and adjustment of the alignment and tightness of the harness without having to separate the garment liner from the outer shell.

(b) Description of Prior Art

A firefighter protective garment is usually a coat, a pant or one-piece coverall consisting of three or more functional layers of fire-resistant materials. The various layers are normally the following:

the outer shell which provides protection against puncture, cuts, abrasion, and heat;

the moisture barrier—consisting usually of a woven or non-woven substrate to which a fire resistant semi-permeable polymer is coated or laminated—which provides resistance to penetration by liquids and blood-borne pathogens while facilitating the transmission of metabolic heat away from the body of the firefighter;

the thermal barrier—usually consisting of an insulating layer of batting or non-woven fabric quilted or laminated to a woven face cloth—which provides the bulk of the resistance to the transmission of heat from the external environment to the body of the firefighter.

A common configuration and orientation of these layers in a firefighter garment is as follows:

The outermost layer is the outer shell fabric. Moving inwards, the next functional layer is the moisture barrier, orientated with the substrate towards the outer shell and the polymer towards the inside. The next functional layer is the thermal barrier, orientated with the thicker and softer insulating layer facing the moisture barrier film and the face cloth towards the body of the firefighter.

Fire fighting protective pants are equipped with suspenders that pass over the shoulders of the wearer.

There is an increasing demand by firefighters to be able to wear a life safety harness while performing fire fighting duties. Industry has responded by making available a variety of harness designs. There are two main types of safety harness used in the fire service:

A Class II life safety harness that fastens around waist and around thighs or under buttocks;

A Class III life safety harness that fastens around waist and around thighs or under buttocks, and over shoulders.

Because the majority of safety harnesses does not employ heat or flame resistant materials, these harnesses cannot be worn on the outside of a firefighter's protective clothing. A firefighter may wear the harness over his station wear pants before donning his firefighter protective clothing. However, to don first the harness, then the protective garment would increase unacceptably the emergency response time of the firefighter. Therefore, the firefighter would like to be able to don his harness and his protective garment simultaneously.

National Fire Protection Association (NFPA) standard 1971, Standard on Protective Ensemble for Structural Fire Fighting, dictates the design and performance requirements for boots, helmets, gloves, trousers and coats intended for structural fire fighting. NFPA 1983, Standard on Fire Service Life Safety Rope & System Components, sets performance requirements for ropes and harnesses used in the fire service.

However, neither standard provides guidance as to how a safety harness may be integrated or used with a structural fire fighting garment. As a result, manufacturers of structural fire fighting clothing have been adapting their products as they see fit to receive such safety harnesses.

The most common approach has been to incorporate the safety harness between the outer shell and the liner of the protective trouser. The parts of the harness to which a rope could eventually be attached pass through slits or openings in either the outer shell fabric or the liner of the garment.

A disadvantage to this design is that a garment with slits or openings located for one particular brand of harness may not be able to accommodate another brand of harness whose straps do not fall in exactly the same place.

A further disadvantage is that the moisture barrier, which is usually the layer immediately inside the outer shell fabric, is the most fragile element of the protective garment. As a consequence, the straps and hardware of the harness can damage the moisture barrier through pressure and friction.

And yet another disadvantage is that there is only a thin layer of outer shell fabric between the harness and the fire fighting environment. Now, many of the components of commercially available harnesses melt at temperatures below the 500° F. minimum requirement that must be met by all the other components of the firefighter garment. Furthermore, even at temperatures as low as 300° F.—temperatures which are frequently encountered in the fire fighting environment—the straps or webbing material of the harness will suffer some loss of tensile strength. As a consequence, this design has the distinct disadvantage of compromising the integrity and performance of the safety harness.

One common design of harness integration involves first donning the pant liner. Then, the firefighter pulls on the harness and adjusts the leg and waist straps. And last, the firefighter pulls on the outer shell of the pant and attaches it to the liner, with critical straps passing through specially constructed openings between the outer shell and liner. Thereafter, whenever the firefighter is called to respond to an emergency he dons the entire pant with harness already in place.

A disadvantage of this system, with the harness components sandwiched between the liner and the outer shell, is that the firefighter cannot readily adjust the fit of the harness, straighten a twisted strap or inspect the harness for damage without separating the liner from the outer shell.

A further disadvantage is that firefighter cannot readily remove the harness from the garment, even if the emergency to which he is responding does not require him to have the protection afforded by a safety harness. As consequence, the firefighter is at all times encumbered by the weight and bulk of the safety harness.

SUMMARY OF INVENTION

It is therefore an object of the present invention to provide a method of harness integration that readily permits both the integration and removal of a safety harness.

It is a further object of the present invention to provide a harness integration system, which is itself easily attachable and detachable from the garment.

It is an object of this invention to protect the safety harness from the heat that may be encountered in the fire fighting environment.

It is another object of the present invention to provide a harness integration system that interfaces with a variety of safety harnesses.

It is another object of the present invention to provide a harness integration system that meets the thermal performance requirements of NFPA 1971.

It is yet another object of the present invention to provide a method of harness integration that removes the need to secure the harness in place via openings in the different layers of the garment, or by the use of fabric loops.

It is another object of the present invention to permit easy inspection, adjustment or alignment of the safety harness when it is integrated in the garment.

It is another object of the present invention to provide a liner integration system that is lightweight yet strong.

It is another object of the present invention to reduce wear and damage to the moisture barrier of the liner by permitting the harness to be worn directly on the station wear pant instead of it being placed between the liner and outer shell of the fire fighter protective trouser.

The above and other objects of the invention may be achieved by providing a fire fighting protective garment adapted to be worn with a firefighter safety harness, the garment comprising a firefighter pant, which includes a waist portion, the protective garment also comprising an interior garment to be disposed inside the firefighter pant and over a station wear pant, and downwardly extending from the waist portion of the firefighter pant, means for removably fixing the safety harness to the interior garment, and means for removably attaching the interior garment to the waist portion of the firefighter pant.

The interior garment is preferably made of a material that does not restrict transmission of perspiration or metabolic heat away from the body of the wearer. For example, the interior garment may designed as a short pant and it may be made of a fire-resistant material, such as a fire-resistant mesh.

The safety harness is preferably made of strapping material including a belt portion, and is normally fixed to the interior garment through the belt portion.

In accordance with a preferred embodiment of the invention, there is thus provided a mesh pant which is made of a material that is preferably fire-resistant to be attached to, yet easily removable from, the innermost layer of the firefighter protective garment. This mesh will retain the harness in place yet permit rapid and easy adjustment of the harnesses straps and buckles.

The mesh, in accordance with the nature of meshes, will not restrict the transmission of perspiration or metabolic heat away from the body of the wearer.

The present invention also relates to a firefighter garment comprising an outer shell, a moisture barrier and a thermal barrier, wherein an integration method is provided for removably attaching a safety harness to the firefighter garment without securing it between the outer shell and the liner and without providing slits and openings therein.

In a preferred embodiment, the invention permits the integration of a Class II or Class III life safety harness into the protective pant of the firefighter ensemble.

According to yet another preferred embodiment, the shoulder straps of a Class III harness replace the suspenders of the firefighter pant thereby keeping the pants in place while reducing the combined weight and bulk of the firefighter garment and harness.

BRIEF DESCRIPTION OF DRAWINGS

The invention is illustrated but is not limited to the preferred embodiment which is shown in the annexed drawings in which.

DESCRIPTION OF PREFERRED EMBODIMENT

Figure 1:
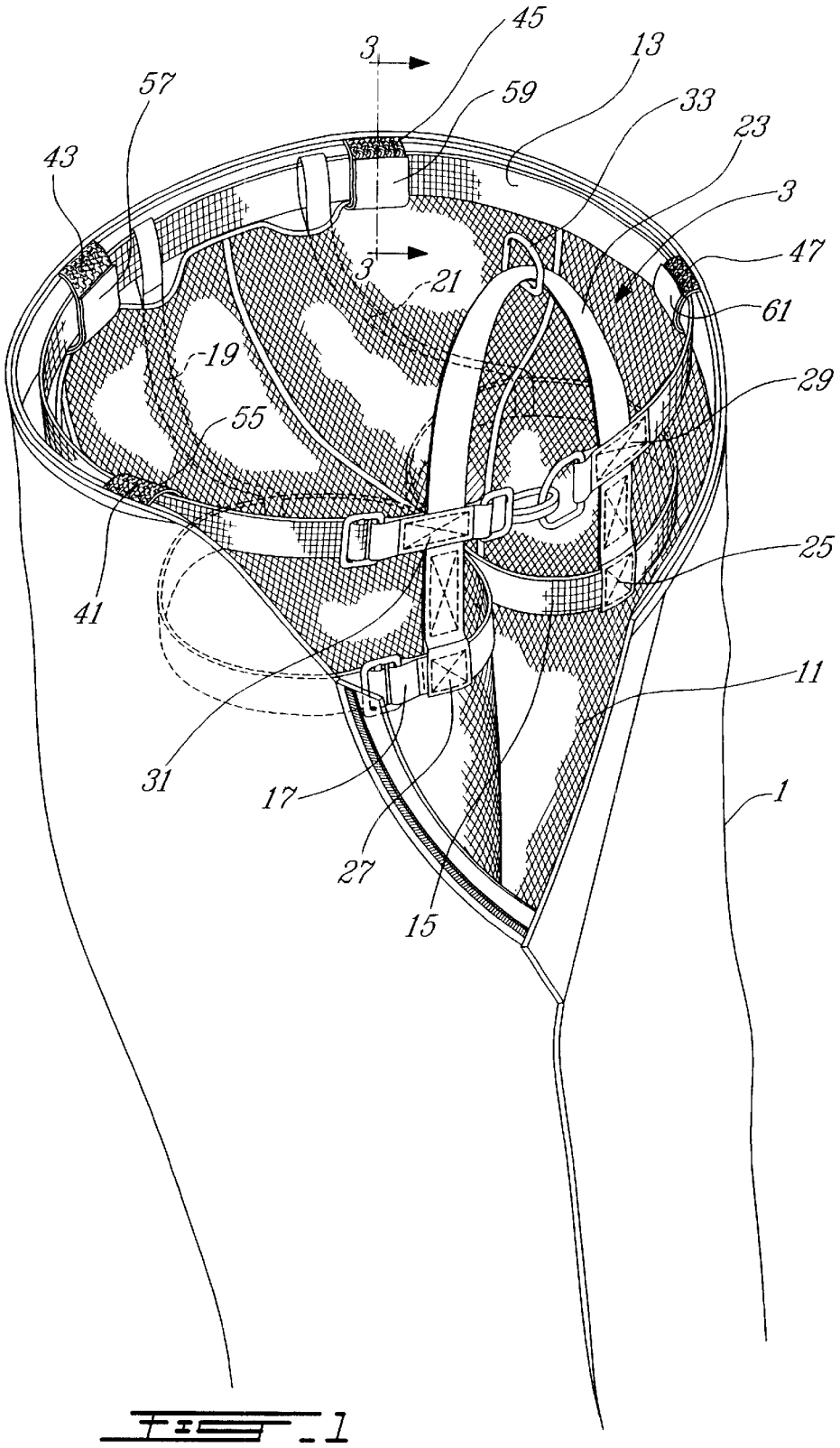
FIG. 1 is a perspective view of a firefighter pant including a fire-resistant mesh according to the invention.

With reference to the drawings it will be seen that a fire fighting protective garment according to the invention includes a firefighter pant 1, which, as will be seen later, has been slightly modified to accommodate a safety harness 3 of standard and known construction. As particularly shown in FIG. 3, firefighter pant 1 is made of three conventional layers which are laminated together and which include an outer shell 5, a moisture barrier 7 and a thermal barrier 9. It is of course understood that any other firefighter pant construction can be used to produce a garment according to the invention.

A garment according to the invention essentially comprises an interior garment which is designed to fit inside firefighter pant 1 and over his station wear (not shown) and which in the illustrated embodiment is in the shape of a short pant 11 which is made of fire-resistant mesh material so that it will not restrict transmission of perspiration or metabolic heat away from the body of the wearer 12.

Figure 2:
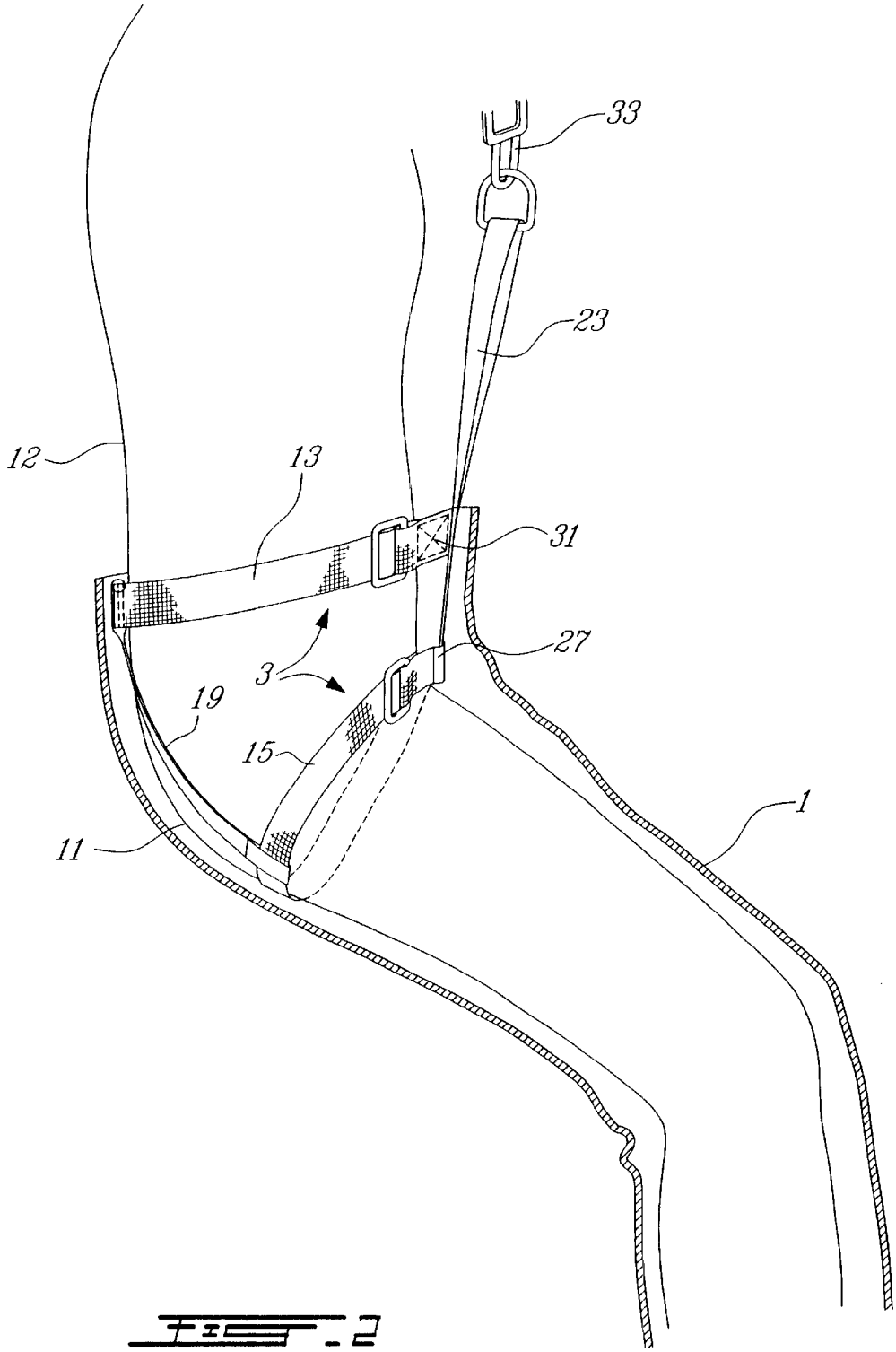
FIG. 2 is a perspective view which schematically illustrates a firefighter wearing a safety harness according to the invention.

Before proceeding further, and with particular reference to FIGS. 1 and 2, a short description of a known harness 3, with which the present embodiment of the invention will be used, will now be given. Essentially, safety harness 3 is made of an arrangement of materials secured about the body and used to support a person during fire service rescue. Safety harness 3 comprises a belt 13, which can be safely buckled as shown. Harness 3 also comprises adjustable thigh straps 15, 17 and connecting straps 19, 21, which are used to join belt 13 to thigh straps 15, 17. Finally, harness 3 comprises a looping strap 23 wherein the ends are fixed at 25, 27 to thigh straps 15, 17 and the mid-portions are fixed to belt 13 at 29, 31. A carabiner 33 associated with looping strap 23 as shown is provided to attach the harness to a rope for either a controlled descent or ascent. Of course, safety harness 3 is only an accessory to the invention as associated with short pant 11 and firefighter pant 1.

Figure 3:
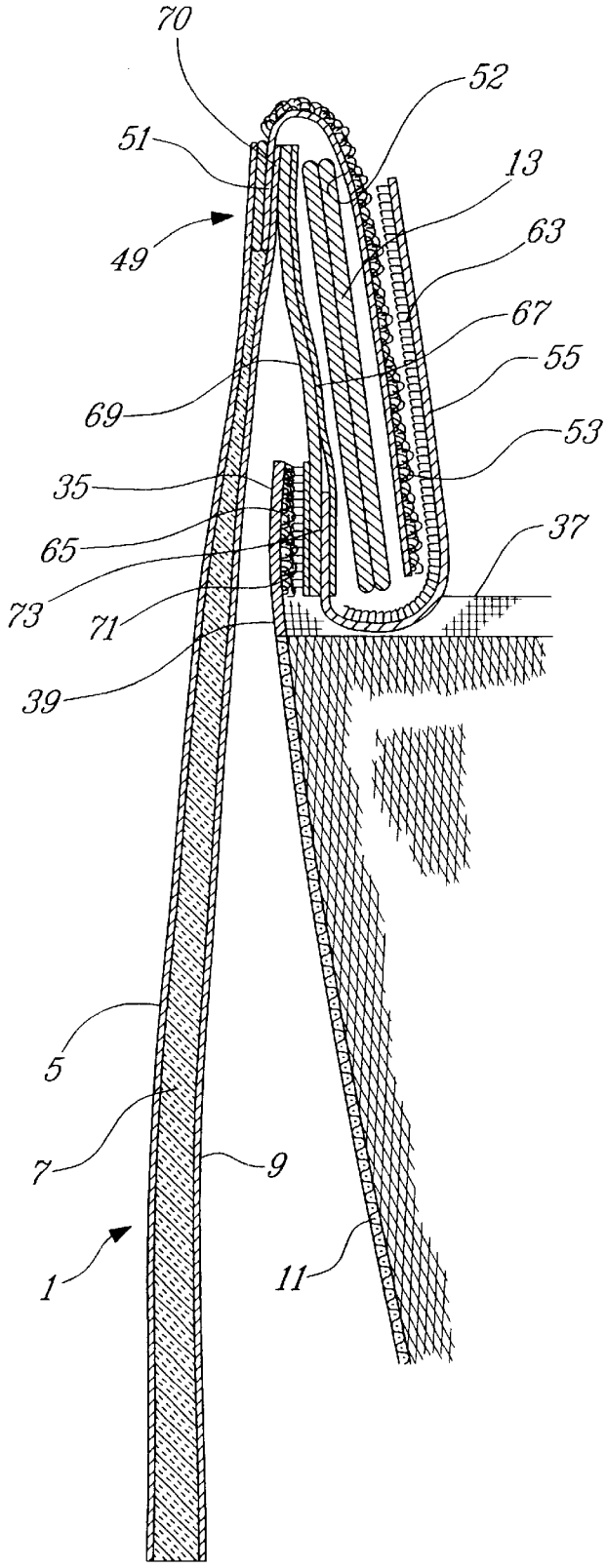
FIG. 3 is a cross-section view taken along line 3—3 of FIG. 1.

To achieve this embodiment, and as particularly illustrated in FIG. 3, mesh pant 11 is provided with four upwardly extending flaps 35 which are disposed around waist line 37 of mesh pant 11, and are fixed thereto at one end 39 thereof in a manner known per se, as will be explained later.

Turning now to firefighter pant 1, there are provided four lap bands 41, 43, 45, 47 which are fixed in known manner such as by gluing or sewing between the layers, to the waist portion of pant 1 as shown at 49. More particularly, one free end 51 of a lap band, here band 52, is firmly laminated, in known manner, such as by sewing or gluing, between thermal barrier 9 and moisture barrier 7 at the upper end thereof. Each lap band 41, 43, 45, 47 has one face covered with an anchoring element 53, such as Velcro®, and is long enough to lap over and downwardly above belt 13 as shown particularly in FIG. 3. There are also provided four additional lap bands 55, 57, 59, 61 which are somewhat similar to lap bands 41, 43, 45, 47 and which are aligned therewith. Lap bands 41, 43, 45, 47 and 55, 57, 59, 61 are also aligned with flaps 35 so as to define a common action therewith, and are distributed as particularly shown in FIG. 1. Similarly as in the case of lap bands 41, 43, 45, 47, lap bands 55, 57, 59, 61 are also covered with an anchoring element, here 63, such as Velcro®.

As mentioned above, mesh pant 11 is provided with four upwardly extending flaps 35, which are arranged around waist line 37 of the mesh pant. It should be noted here that these flaps are exactly aligned with lap bands 41, 43, 45, 47 and 55, 57, 59, 61. Flaps 35 are each provided, as shown, with an anchoring element 65, such as Velcro®, and its purpose will be described later.

The fire protective garment which is illustrated also comprises pairs of downward flaps 67 and 69 which are aligned with each lap bands 41, 43, 45, 47 and 55, 57, 59, 61, and which are laminated together as shown. Flaps 67 and 69 are both fixed at their upper ends at 70 such as by sewing or otherwise, to the waist portion, interiorly of the firefighter pant 1. At the lower end of flap 69 there is an anchoring element 71, such as Velcro®, which is arranged to fixedly and removably engage with anchoring element 65, thereby attaching short mesh pant 11 to firefighter pant 1. Finally, lap bands 55, 57, 59, 61 have their lower ends fixed in known manner as shown in FIG. 3 between the lower ends of flaps 67 and 69.

So, to prepare a garment according to the illustrated embodiment of the present invention, for subsequent rapid use in the case of a fire which requires the use of a harness, a firefighter first dons short mesh pant 11 over his station wear pant. He then puts on harness 3 with thigh straps 15, 17 over the thigh portions of mesh pant 11 and belt 13 lying just above waist line 37 of mesh pant 11. He then puts on firefighter pant 1 over harness 3 and mesh pant 11 and first engages Velcro® 65 and 71 which will attach mesh pant 11 to firefighter pant 1. Then, he folds lap bands 41, 43, 45, 47 over belt 13 and thereafter he folds lap bands 55, 57, 59, 61 under belt 13 and engages them with lap bands 41, 43, 45, 47 through their respective Velcro® 53, 63. The garment according to the illustrated embodiment of the invention can thereafter be removed or put on in a matter of seconds. It will also be realized that with such an arrangement, the harness will not damage the moisture barrier of the firefighter pant, and will need no further adjustment.

The above embodiment was described in conjunction with a Class II safety harness. In such a case, the firefighter pant will be worn with suitable suspenders. If a class III safety harness is used, the shoulder straps thereof merely replace the suspenders, which are normally used in association with a firefighter pant. Although the invention has been described with reference to a specific embodiment, it is understood that modifications are possible, provided they are within the scope of the appended claims.

I claim:

1. A fire fighting protective garment adapted to be worn with a firefighter safety barness, said garment comprising a multi-layer firefighter pant, said firefighter pant including a waist portion, said protective garment also comprising an interior garment to be disposed inside said firefighter pant and over a station wear and downwardly extending from said waist portion, wherein said interior garment is of a material that does not restrict transmission of perspiration or metabolic heat away from body of wearer and is made of fire-resistant material, means for removably fixing said safety harness to said interior garment, and means for removably attaching said interior garment to said waist portion of said firefighter pant.

2. The fire fighting protective garment according to claim 1, wherein said interior garment is of a material that does not restrict transmission of perspiration or metabolic heat away from body of wearer.

3. The fire fighting protective garment according to claim 1, wherein said interior garment is designed as a short pant.

4. The fire fighting protective garment according to claim 3, wherein said interior garment is made of a mesh material.

5. The fire fighting protective garment according to claim 2, wherein said interior garment is made of a fire-resistant material.

6. The fire fighting protective garment according to claim 5, wherein said interior garment is made of a fire-resistant mesh.

7. The fire fighting protective garment according to claim 1, wherein said safety harness is made of strapping material including a belt portion, said safety harness being fixed to said interior garment through said belt portion.

8. A fire fighting protective garment adapted to be worn with a firefighter safety harness, said safety harness being made of strapping material including a belt portion, said garment comprising a multi-layer firefighter pant, said firefighter pant including a waist portion, said protective garment also comprising an interior garment to be disposed inside said firefighter pant and over a station wear and downwardly extending from said waist portion, said interior garment being made of a material that does not restrict transmission of perspiration or metabolic heat away from body of wearer and is made of fire-resistant material, means for removably fixing said safety harness to said interior garment comprising a plurality of first lap bands extending from the waist portion of said firefighter pant and arranged to lap above and over said belt portion, a plurality of second lap bands respectively aligned with said first bands and also extending from said firefighter pant at the waist portion thereof, and arranged to lap below said belt portion and over respective first bands, in fixed engagement therewith, and means for removably attaching said interior garment to said firefighter pant.

9. The fire fighting protective garment according to claim 8, wherein said means for removably attaching said interior garment to said firefighter pant comprise a plurality of flaps upwardly extending from waist line of said interior garment and a plurality of flaps downwardly and interiorly extending from said waist portion, and anchoring means provided with said flaps to cause engagement of said upwardly extending flaps and said downwardly and interiorly extending flaps to attach said interior garment to said firefighter pant.

10. A method for integrating a harness into a fire protective garment which comprises providing a multi-layer firefighter pant including a waist portion, providing an interior garment fitting inside said firefighter pant and over a firefighter station wear, said interior garment being made of a material that does not restrict transmission of perspiration or metabolic heat away from body of wearer and is made of fire-resistant material, mounting a safety harness over said interior garment with belt portion thereof above waist line of said interior garment, removably fixing said safety harness to said interior garment, and removably attaching said interior garment at the waist portion of said firefighter pant.

* * * * *